US006102799A

United States Patent [19]

Stupak

[11] Patent Number: 6,102,799

[45] Date of Patent: Aug. 15, 2000

[54] METHOD FOR PROVIDING A SUPER JACKPOT FOR GAMING MACHINES

[76] Inventor: Bob Stupak, 910 Rancho Cir., Las Vegas, Nev. 89107

[21] Appl. No.: 09/009,141

[22] Filed: Jan. 20, 1998

[51] Int. Cl.[7] ..... A63F 9/24

[52] U.S. Cl. ..... 463/27; 463/25

[58] Field of Search ..... 463/27, 26, 25, 463/29, 40, 41, 42, 1, 16, 17, 18, 19, 20, 21; 902/23; 705/500, 400, 39, 35, 1

[56] References Cited

U.S. PATENT DOCUMENTS

| | | | |
|---|---|---|---|
| 5,116,055 | 5/1992 | Tracy | 463/25 |
| 5,275,400 | 1/1994 | Weingardt et al. | 463/25 |
| 5,564,700 | 10/1996 | Celona | 463/27 |
| 5,851,147 | 12/1998 | Stupak et al. | 463/13 |
| 5,913,726 | 6/1999 | Jones et al. | 463/13 |
| 5,984,779 | 11/1999 | Bridgeman et al. | 463/16 |

*Primary Examiner*—Jessica J. Harrison
*Attorney, Agent, or Firm*—Philip J. Anderson; Quirk & Tratos

[57] ABSTRACT

A method and system are set forth of providing for a super jackpot to be awarded should a qualifying super jackpot combination be obtained by any player playing gaming machines supplied by a supplier to a host facility. The machines are independent, each having a super jackpot combination obtainable based upon a predetermined probability. The host facilities each pay periodic contributions which go to a super jackpot fund. The contribution stream is sufficient to at least fund the super jackpot prior to having to pay it out to a player. The periodic contributions may be fixed. The super jackpot fund may progressively increase over time until the winning combination is obtained.

19 Claims, 1 Drawing Sheet

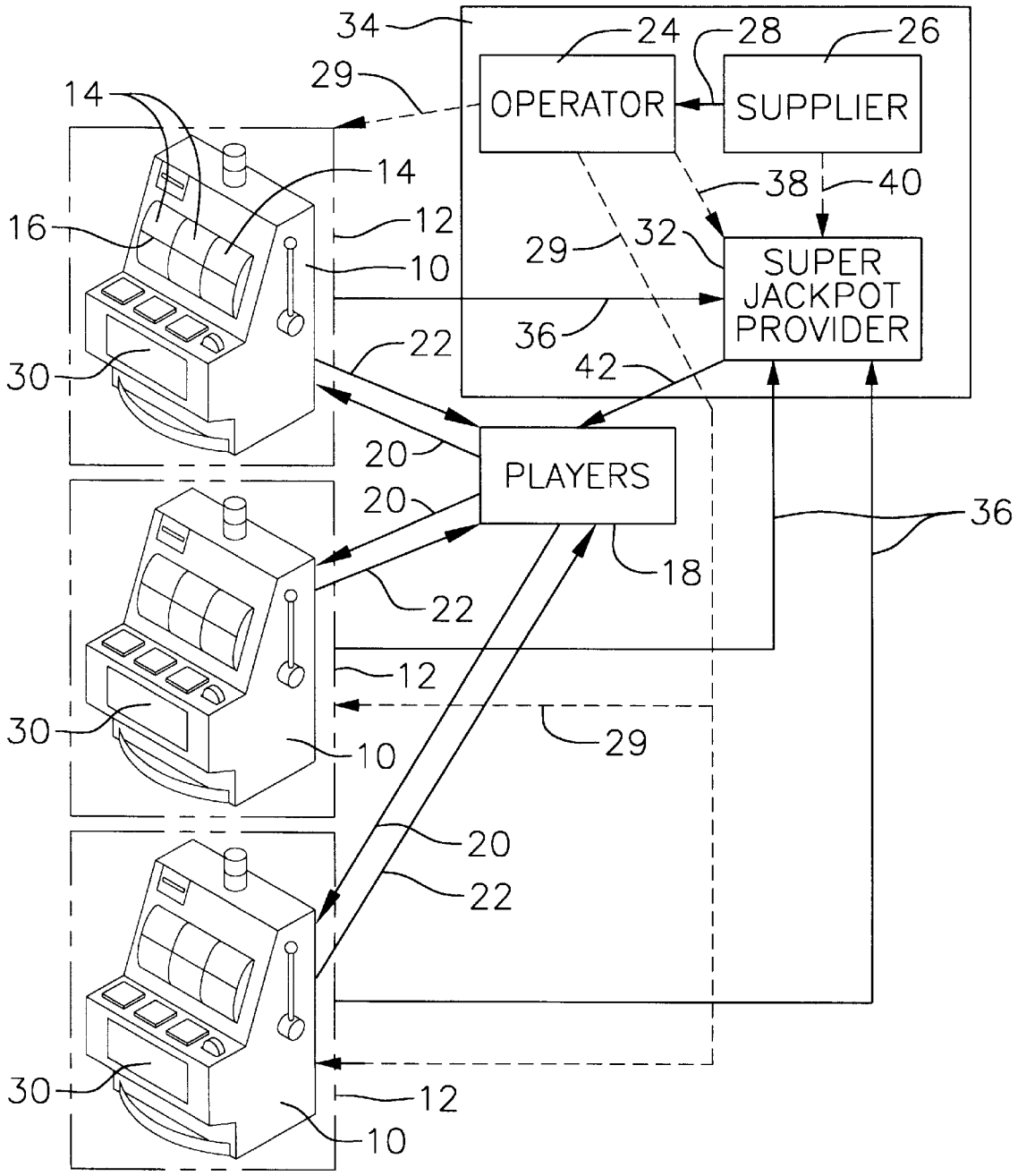
34
24
28
26
29
OPERATOR
SUPPLIER
14
14
38
40
16
12
29
32
10
SUPER
JACKPOT
PROVIDER
36
22
30
42
20
PLAYERS
20
36
18
22
12
30
29
10
20
22
30
12
10

METHOD FOR PROVIDING A SUPER JACKPOT FOR GAMING MACHINES

FIELD OF THE INVENTION

The present invention relates to a method for providing a super jackpot for independent, remotely located, unlinked gaming machines.

BACKGROUND OF THE INVENTION

Gaming machines such electro-mechanical and video display slot machines are well known and popular gaming devices. As but an example, electro-mechanical machines typically include three or four reels each having indicia disposed about the peripheries separated by blanks. A player, to play the machine, enters a wager such as by inserting one or more quarters or tokens and initializes the machine by pulling a handle or pressing a button. Initialization rotates the reels to display combinations of indicia and blanks on a designated payline. If a predetermined winning combination appears on the payline, the machine pays the player. If no winning payout combination appears, there is no payoff, and the wager is lost and retained by the machine.

For any machine, the wager placed by the player for each hand or spin is called the "play". For any spin the maximum that can be wagered is the "maximum play". For dollar slot machines, the maximum play is typically two or three dollars and for quarter machines, the maximum play is typically three coins.

Over a period of time such as a twenty-four hour period, a week, a month or a year, the total "play" defines the "handle" for the machine, i.e. the amount of wagers dropped by the players into the particular machine over the relevant time period. For any selected period of time, e.g. a month, the handle minus the amount paid to players for winning combination payouts defines the "drop" or "hold" for the machine. Thus hold is the gross profit realized by the machine. Depending upon who owns and hosts the machine, this hold may be profit to a casino, slot machine owner or slot machine lessee who placed the machine at the particular location.

Recently it has been known to provide progressive, super jackpots funded by a portion of the play of each of a plurality of electronically linked or networked machines. Each machine, in addition to the other symbols or combination which provide for lessor payouts, includes symbols indicative of a super jackpot which, if aligned on the payline, provides a huge jackpot payout. These super jackpots may be ten thousand or a million times the amount of the maximum play or more. For example, a three dollar play in a dollar machine may result in super jackpot of millions.

The networked super jackpot machines as described above are linked within the casino and, through dedicated telephone lines, to other machines in casinos in different, remote locations. It has become popular for a sponsor, an entity separate from the host location of the machine such as a casino, to install the networked machines in the casinos and the casinos would either charge a space rental fee to the sponsor, or share in the hold, or a combination thereof.

The networked machines are each electronically linked to a remote processor which allocates a portion of each play to contribute to the progressively increasing super jackpot. The linking also provides other information to the processor including signals a representative that a jackpot combination has been obtained. The processor also issues signals to displays associated with the machines to notify players at the remote locations of the current amount of the progressive jackpot.

As stated above, some of these progressive jackpots start at, for example, three million dollars for dollar slot machines based on a maximum play of three dollars. These progressive jackpots grow, based upon the portion of the play allocated to the super jackpot, the total play and the probabilities of a super jackpot combination appearing on a machine.

When a super jackpot appears, the network game sponsor, instead of the casino, pays the super jackpot to the player. The arrangement between the hosting casino and the sponsor may require the casino to pay lessor jackpots which cannot be paid by the individual machines. In some networked games of the type described above, the super jackpot is paid over time, e.g. twenty years, enabling the sponsor to purchase annuities to pay super jackpots and thus, fund them at a discount compared to their face value.

As can be appreciated, the electronic networking and play allocation enables the sponsor to provide these progressive, super jackpots. These super jackpots, in turn, entice players to play these machines in the hopes of obtaining the super jackpot. Where the progressive super jackpot reaches certain levels, the number of players playing the machines can be such as to create lines of players at these machines. As can further be appreciated, the increase in the number of players increases the handle for the machine, the amount of hold and therefore the revenue to those sharing in the machines' profits.

These super jackpot machines are typically installed in casinos due to the cost of the machine, processing network and telephone line costs necessary to establish the linking and the funding of the super jackpots. Casinos typically experience sufficient drop and hold for the machines to not only pay fixed expenses associated with the acquisition, installation and networking of the machines, funding of the jackpot, but provide a profit margin for the casino and super jackpot sponsor.

These various factors have worked for the most part to exclude these super jackpot machines from an entire market for gaming services in facilities such as restaurants, bars, convenience stores, supermarkets and the like in which relatively small numbers of machines are located. While these facilities may host a plurality of either unlinked, independent video poker gaming machines or provide for intrafacility linking of the machines, super jackpots of the type described above, have not been provided because it is uneconomical to link or network such machines in these markets. Therefore there is insufficient handle and hold to provide for the hosting of these machines at these types of facilities and to fund the super jackpots.

In many instances these video poker gaming machines are provided by an outside supplier, who may own the machines outright or lease them from a manufacturer. The supplier, which may be what is referred to as a slot machine route operator, would install the machines in a facility and pay the facility a monthly fee, retaining the hold on the machines as gross profit. If the facility has suitable licensure from the proper authorities, it may install and operate its own machines, may enter into a share agreement with the slot machine route operator to share a portion of the hold or may enter in some type of hybrid agreement wherein the route operator pays a monthly fee and the facility shares in the hold.

In those instances where the facility, e.g. bar, shares in the hold, any large jackpots affect the bars share since it is taken out of the total handle for the relevant time period. The sharing of the jackpot payout in proportion to the share of the handle has also precluded smaller venues from hosting large payout slot machines. The may be insufficient handle to recover from being hit with a large jackpot.

There is, therefore, a need to provide to these noncasino and smaller casino markets a method for providing super jackpot machines, heretofore foreclosed from such facilities, so that this market too can share in revenues produced thereby.

SUMMARY OF THE INVENTION

There is, therefore, provided according to the present invention, a method for providing super jackpot gaming machines to markets heretofore economically foreclosed from hosting such machines.

The method includes a supplier supplying at least one, independent, machine to each of a plurality of remote host facilities which may be a bar, restaurant, supermarket, convenience store or the like. Each machine includes a super jackpot combination having a predetermined probability of occurring. Play of the machine by players at the host facility produces revenues to the supplier and the host facility.

To establish a super jackpot fund, the method includes assessing a one time or periodic fee for each machine supplied, paid by at least one of the supplier and host facilities. If the supplier of the machine is other than the super jackpot provider, then either the supplier or each of the host facilities or both can pay a fee to the jackpot provider to fund the super jackpot. On the other hand, if the supplier and super jackpot fund provider are one and the same, the fee is assessed against each of the host facility. This fee is less than the assessed entities revenues received from each machine so that, even with paying the assessed fee, the facility will experience a profit from the machines. The funding of the super jackpot from the assessed fees is at a level, in comparison to the probability of the super jackpot occurring, sufficient to at least fund the super jackpot in advance of the super jackpot occurring.

Finally, the method includes paying the super jackpot to a player who obtained the qualifying super jackpot combination.

The super jackpot fund provider, as stated above, can be the machine supplier such as a vending machine route operator, a machine manufacturer or an entirely separate entity which simply administers the super jackpot fund, receives the fees therefor and pays the super jackpot.

BRIEF DESCRIPTION OF THE DRAWING

These and other features and advantages will become appreciated as the same becomes better understood with reference to the specification, claims and the drawing which is a system diagram for the method according to the present invention.

DETAILED DESCRIPTION OF THE PREFERRED EMBODIMENT

Turning to the drawing, the method, according to the present invention, includes the installation and operation of gaming machines 10 shown for purposes of illustration as the electro-mechanical slot machines. One or more independent gaming machines 10 are installed in each of a number of remote host facilities 12, which may be bars, restaurants, convenience stores, supermarkets or the like or any combination thereof.

Each of the game machines 10 is self-contained, independent and not linked or networked with any other gaming machines or external processors. By independent what is meant is that the machines 10 are not linked for communication with any other machines or with a remotely located processor in a manner heretofore employed for a super jackpot network of machines of the type described above. In other words, each gaming machine 10 is a stand alone unit.

As illustrated, and as well known in the art, each gaming machine 10 of the electro-mechanical, spinning wheel type, includes a number of reels 14, each having a plurality of indicia distributed about the reel 14 in a manner well known in the art. The indicia may be well known "bar", "7"s, depictions of fruit such as cherries, lemons and oranges or any other indicia. These indicia may be spaced by blanks.

An internal processor controls the operation of each gaming machine 10. In well known fashion when initialized, the processor controls a motor to initiate the spinning of the reels 14 which thereafter stop so as to align the indicia and/or blanks along a payline 16. Depending upon the combination of indicia and blanks aligned on the payline 16, either a winning combination or a losing combination is obtained. Depending upon the winning combination obtained, the machine 10 dispenses coins or adds to an inventory of credits signifying that this particular winning combination payout has been made. If a losing combination is obtained, there is no payout and any wager is retained by the machine 10.

In accordance with the method of the present invention, each of the gaming machines 10 includes indicia on the reels 14 which, if aligned on the payline 16, signify that a super jackpot has been obtained. The number of reels 14, indicia and blanks on each reel 14 and the number and distribution of the super jackpot indicia can be adjusted to obtain a predetermined probability that a super jackpot combination will be obtained at the payline 16. As but an example, the probabilities of obtaining the super jackpot combination at the payline 16 may be one in three million.

By super jackpot what is meant is that the payout when a super jackpot combination is obtained is at least approximately one million and preferably three millions times the single spin maximum play for the machine 10.

As shown in the drawing, players shown generally 18, at each host facility 12, play the gaming machines 10 by making wagers at the machines 10. Players 18, may make the wagers by inserting coins or tokens into the gaming machine 10 or by inserting paper currency in a bill reader (not shown) associated with each machine. As stated above, each of the gaming machines 10 has a maximum play which may be, for dollar machines, three dollars per play or for quarter machines, three quarters. The players 18 may make lesser wagers; however, this will effect the payout schedule. Further, the super jackpot can only be obtained with maximum play.

As illustrated in the drawing, the play of the gaming machines 10 by players 18 results in the players inserting wagers collectively referred to as handle 20 into the machines represented as the combined play over a time period, such as a month or year.

As also illustrated in the drawing, when a winning combination is obtained on the payline 16, the gaming machines 10 make payouts 22 to the players 18. A payout schedule is associated with each machine 10 to describe the amount of the payout versus the amount of play and the winning combination obtained. The payout will vary, depending upon the winning combination and the amount of play. For relatively small payouts, the gaming machines 10 make the payouts by either accumulating credits, which can either be played by the player 18 or collected, or by immediately dispensing tokens. For some larger payouts, it may be necessary to have a cashier make the payment in cash since the gaming machines 10 may not hold sufficient tokens to make the payouts.

In that the host facility 12 is relatively a small operation, it is impractical for it to purchase and operate the gaming machines 10 on its own. Further, the host facility 12 may not have the requisite gaming licensure to enable it to legally own and operate such devices. Still further, even were the host facility 12 licensed to provide such machines, there may be insufficient handle 20 to support the offering of large jackpots at the machines 10. Accordingly, the gaming machines 10 are supplied to the host facility 12 by an outside entity shown in the drawing as a slot route operator 24. The operator 24 is an independent company which obtains the gaming machines 10 and licensure and makes arrangements with the host facilities 12 to install and maintain the gaming machines 10 thereat. In this fashion, the host facility 12 does not have the capital expense to acquire the machines nor the ongoing duty to maintain and service them nor the expense of obtaining a license. The operator 24 may provide gaming machines 10 to a number of host facilities 12.

The operator 24 may acquire the machines from a supplier 26 either by outright purchase or through a lease represented by transaction 28. In the transaction 28, the machines 10 are provided to the operator 24 who in turn pays for the same either through a purchase arrangement or through periodic lease payments.

The arrangement through which the operator 24 supplies the gaming machines 10 to the host facilities 12, can be of various types and are graphically illustrated by broken arrows indicating supply 29. While the host facilities 12 could purchase the gaming machines 10 outright from either the operator 24 or supplier 26, in most situations the host facilities 12 are relatively small operations such as bars, restaurant, convenience stores or the like, who do not wish to incur the capital outlay to acquire, maintain and service the gaming machines 10, but instead enter into an arrangement wherein the host facility 12 can host the machines for the play and enjoyment of its patron players 18 while at the same time receive revenues therefrom. In one type of supply 29 the operator 24 enters into an arrangement with the host facilities 12 to install the gaming machines 10, the operator 24 paying the host facility 12 a monthly rental fee and the operator 24 keeping the revenues generated by the gaming machines 10. In this arrangement, the host facilities 12 have an interest in providing a venue for the gaming machines 10, in receiving the periodic rental fees which may entice patrons into the facility 12, and in enjoyment of the benefits of such patronage by the sale of beverages, food or other products to those patrons. Under this type of supply 29, the facilities 12 do not participate in any revenues received through operation of the gaming machines 10 nor do they bear the capital expense of acquisition, maintenance and service of the gaming machines 10. In another type of supply 29, the operator 24 installs the gaming machines 10 in the host facilities 12 and the operator 24 host facilities 12 share in the revenues generated through the operations of the gaming machine 10. This arrangement may also include the sharing of maintenance cost for the machines 10. A further type of arrangement may be a hybrid wherein the operator 24 pays the host facility a rental fee and the operator 24 and host facilities 12 share in the revenues produced by the operation of the gaming machines as well as in the maintenance costs.

Regardless of the manner of supply 29 of the machines 10 to the host facilities 12 described above, which are well known, the players 18 play the gaming machines 10 at the host facilities 12 producing the handle 20. Winning combinations produce the payouts 22 to the players 18. Over a discrete time period such as a month or a year, by way of example, the difference between the handle 20 and the payout 22 of any gaming machine 10 produces a hold 30 graphically represented in the drawing. The combination of the holds 30 for all the gaming machines 10 in any particular host facility 12 creates a profit revenue from the gaming machines 10. If the supply 29 is an outright purchase of the machines by the host facilities 12, the host facilities 12 retain the hold 30. If the supply 29 is of the type where the operator pays the host facility 12 a rental fee, the hold 30 is collected by the operator 24 from time to time and is revenue for its operations. In a hybrid type of supply 29, the hold 30 would be shared by the operator 24 and host facilities 12 in a manner profitable to both.

The arrangements hereinabove set forth for the placing of gaming machines 10 in host facilities 12 has not provided for the offering of super jackpots. Unlike current super jackpot systems, the gaming machines 10 for the various remote facilities 12 are not networked. Interfacility networking of gaming machines, which is done through telephonic communications, in addition to the funding of the super jackpots as heretofore practiced in the art, has economically precluded the placing of super jackpot offering gaming machines in these non-casino host facilities 12. It is to be understood that the offering of a super jackpot for the gaming machines 10 is an inducement to players 18 to play the gaming machines 10 which increases the handle 20 and the amount of the hold 30. This is particularly true where the super jackpot is progressive, growing periodically or continuously from an initial level until the super jackpot is won. Hosting such super jackpot machines further increases the patronage of the facility 12 by players 18 who may buy food or beverages or other goods.

With continuing reference to the drawing, and to enable super jackpot offering gaming machines 10 to be placed in host facilities 12 of the type described above, the method, according to the present invention, includes the establishment of a super jackpot fund by a super jackpot provider 32. As shown in the drawing, the super jackpot provider 32 may be an entity separate and apart from the gaming machine supplier 26 and slot route operator 24. Preferably the operator 24, supplier 26 and super jackpot provider 32 are one entity, the gaming machine manufacture as illustrated by box 34. It is to be further understood that the super jackpot provider 32 could also be the machine supplier 25 with the independent slot route operator 24 obtaining the machines from the supplier/provider in the manner as described above and installing the gaming machines 10 in the host facilities 12.

The super jackpot provider 32 establishes and administers a fund which may be money or other goods or services such as automobiles, vacations or homes, to be paid to a player 18 who, during the play of a gaming machine 10, obtains a qualifying super jackpot combination. To provide a means to contribute revenues to the provider 32 for establish and maintenance of the fund, moneys are contributed from one, several or all of the host facilities 12, operator 24 and supplier 25. Where funds are to be contributed from the host facility 12, each host facility 12 contributes a periodic, fee to the provider 32. This fee which may be fixed may be contributed weekly, monthly or annually and preferably is less than the revenues received by the host facilities 12 from the operation of gaming machines 10. For example, if the host facility 12 receives only a periodic rental or location fee from the operator 24, a portion of that periodic fee would be contributed to the provider 32 as shown by funding 36. In this embodiment of the method, according to the present invention, the host facilities 12 through their funding 36, fund the super jackpot.

Alternatively or additionally, the operator 24 may provide funding 38 for the super jackpot fund to the provider 32 from its revenues received from the operation of the gaming machines 10. For example, where the operator 24 pays a lease fee to the host facilities 12 and retains the hold 30 generated by the gaming machines 10 on its own account, a periodic fee paid by the operator 24 to the provider 32 would represent the funding 38. This fee would be less than the revenues received by operator 24, i.e. the hold 30 less the expenses associated with the machine such as lease payments to the supplier 26, rental payments to the host facilities 12 as well as operational costs associated with the operation of the gaming machines 10 to provide a profit to the operator 24. The operator funding 38 may be in lieu of or in addition to the host facility funding 36*a*.

Still further, the machine supplier 26, e.g. manufacturer, can provide supplier funding 40 to the provider 32 as a periodic fee which is less than its revenues received from the gaming machines 10. For example, if the supplier 26 leases the machines to either the operator 24 or host facilities 12, the supplier funding 40 would be less than the net revenue realized from such leasing arrangements. Again the supplier funding 40 may be in lieu of or in addition to the operator funding 38*b* and host facility funding 36*a*.

Still further, where the gaming machines 10 are purchased outright, the purchase price therefor may include a fee which acts to fund the jackpot providers funding of the super jackpot. In this embodiment, the purchaser in essence buys the gaming machine 10 with an included funding of the super jackpot. The purchase price increment allocate to the funding of the included super jackpot is an amount which takes into account the number of gaming machines 10 sold or to be sold, the probabilities of the super jackpot combination occurring, the price of an annuity to pay the super jackpot and the like.

Whatever the method used, the host facility 12 can acquire and place gaming machines 10 in their business which offer super jackpots without risking financial loss if the super jackpot combination is obtained. If indeed the super jackpot is obtained, the jackpot provided 32 pays the jackpot to the player. Further, the host facility 12 can encourage players to achieve the super jackpot since it is not at risk of having to pay all or a portion of the jackpot.

Again, a single entity 34 may provide all the services of the operator 24, supplier 26 and super jackpot prover 32. Furthermore, this entity 34 may not be responsible for the maintenance of the gaming machines 10, that obligation falling on the host facilities 12 which may, in turn retain the services of a independent slot machine maintenance service.

Regardless of the source of funding of the super jackpot to the provider 32, each source of funding is such that the net revenues received from the operation of gaming machines 10 is greater than the contributions paid to the provider 32. In this manner the method provides profit to the host facilities 12, operator 24, supplier 26 or any combined entity 34. Furthermore, the contribution, referred to above, may not be quantitatively fixed but may be paid according to a schedule based upon the play 20 of the gaming machines 10 at each host facility 12. For example, for host facilities 12 having lesser play, and therefore handle and hold, periodic funding 36 provided to the super jackpot provider 32 may be less than a host facility 12 which experiences greater play 20. The scheduled fee contributions may also be based not only upon play, but the handle 20 or hold 30.

The fees contributed to the provider 32 are such as to fund the super jackpot to be paid in advance of a super jackpot being obtained by a player 18. As stated above, based upon the number of indicia, number of super jackpot indicia, and number of reels 14, a discrete probability can be calculated as to the number of plays which should occur before a super jackpot is obtained. Based upon a number of plays per week or month of the gaming machines 10 and the periodic contributions received by the provider 32, the contributions are such as to produce an income stream to the provider 32 sufficient to at least fund the super jackpot prior to it occurring and, at the same time, cover operational expenses. Preferably the income stream also provides a profit margin to the provider 32.

While the provider 32 may choose to assemble the jackpot fund from the contributions received and pay it in lump sum to any player 18 hitting the super jackpot, the provider 32 may, from the contributions income stream, pay the super jackpot over a period of time, e.g. five years or twenty years. In this manner, the provider 32, from the income stream, can pay the periodic payments to the super jackpot winners or, alternatively, can purchase annuities providing the same, obtaining a discount in comparison to the face value of the super jackpot.

When a player 18 obtains a qualifying super jackpot combination, the super jackpot is paid to the player by the provider 32 or entity 34 as shown at 42 as either a lump sum, an annuity or a combination thereof. Where the super jackpot is incrementally increased over time, when the super jackpot is paid, the super jackpot fund available for the next super jackpot resets to a preselected minimum such as one million dollars and begins it incremental increase anew.

Still further, where the super jackpot progressively increases from the preselected minimum, means may be provided to inform the players 18 at each facility 12 of the size of super jackpot. This may be either to a display which is manually reset by the provider 32 or reset through radio signals or the like.

While the drawing shows the gaming machine 10 as being electro-mechanical, reel slot machines, it is to be understood that the gaming machine 10 can be of the type having the video presentation of reels and can be of the type having multiple paylines. Further, the gaming machines 10 can be other types of machines such as video poker machines where, in a qualifying super jackpot, may only result in a sequential royal flush in a particular suit or any other suitable gaming machine wherein a super jackpot combination has a sufficiently low probability of occurring, e.g. one in several million, to enable the super jackpot fund to be funded prior to a player 18 hitting the jackpot.

According to the method and its various embodiments described above, host facilities 12 or the type described above, can host super jackpot gaming machines 10 to induce greater play of the gaming machines 10 at its establishment and increase its revenues, if not from the operation of the gaming machines 10 themselves, from the ancillary benefits of increased patronage, sales of the goods or providing other services to its patrons such as food, drinks and the like.

While I have shown and described certain embodiments of the present invention, it is to be understood that it is subject to many modifications without departing from the spirit and scope of the claims.

I claim:

1. A method for providing a super jackpot for remotely located, independent gaming machines comprising:

a supplier supplying at least one machine to each of a plurality of host facilities, each machine including a super jackpot combination having a predetermined probability of occurring;

establishing a super jackpot fund from which to pay players said super jackpot;

funding said super jackpot by assessing a contribution for each machine supplied and paid by at least one of said supplier and host facilities, said funding at a level in comparison to the probability of said super jackpot occurring sufficient to at least fund the super jackpot in advance of the super jackpot occurring; and paying the super jackpot to a player obtaining the super jackpot combination.

2. The method of claim 1 wherein said super jackpot is progressive the method further including periodically increasing the funding to said fund from said contributions to increase said super jackpot fund.

3. The method of claim 1 further including funding said super jackpot at a level, in comparison to the probability of the super jackpot occurring, to more than fund an annuity fund of an amount representing said super jackpot.

4. The method of claim 1 further including paying the super jackpot to the player in installments.

5. The method of claim 4 further including funding said super jackpot at a level, in comparison to the probability of the super jackpot occurring, to more than fund an annuity fund of an amount sufficient to pay said installments.

6. The method of claim 1 wherein said supplier supplies the machines and establishes the super jackpot fund, the method further including assessing periodic contributions to be paid by the host facilities.

7. The method of claim 1 wherein said assessed contribution is periodic and fixed.

8. The method of claim 7 further including setting said fixed contribution based at least in part on a handle determined for said machine.

9. The method of claim 1 wherein each machine has a maximum play, the method including funding the super jackpot to at least one million times the maximum play for the machine.

10. A method for providing a super jackpot for remote, independent gaming machines comprising:

a supplier supplying at least one machine to each of a plurality of host facilities, each machine including a super jackpot combination having a predetermined probability of occurring, play of said machines by players resulting in revenue to the supplier and host facility;

a provider establishing a super jackpot fund to fund the payouts of each super jackpot;

funding each super jackpot by assessing a periodic fixed contribution to be paid by at least one of said supplier and host facilities, said contribution paid to the provider, funding at a level in comparison to the probability of said super jackpots occurring sufficient to at least fund the super jackpots in advance of the super jackpots occurring; and the provider paying super jackpots to players obtaining the super jackpot combination.

11. The method of claim 10 wherein the super jackpot funding step includes each host facility paying a periodic contribution to the provider, said contributions from the facilities sufficient to produce an funding stream which is sufficient to at least fund the super jackpot in advance of the super jackpots occurring.

12. The method of claim 11 wherein the contribution by each facility is at least based upon the drop for the machines supplied thereto.

13. The method of claim 10 wherein the supplier and provider are a single entity supplying the machines and receiving the assessed contributions from the host facilities.

14. A method for operating a plurality of independent gaming machines in remote locations and providing a super jackpot therefore, the method comprising:

a supplier providing a plurality of independent gaming machines to a plurality or remote host facilities;

programming each of said machines to provide for a super jackpot combination payout of at least one million times the amount wagered thereon, said super jackpot combination having a predetermined probability of occurring for each play of the machine;

each facility contributing a periodic payment to the supplier at least sufficient to fund, based upon the probability of the super jackpot occurring, the super jackpot combination paid out when the same appears on any of said machines.

15. The method of claim 14 wherein the contributed periodic payment is a fixed payment amount.

16. The method of claim 15 wherein the fixed payment amount for each host facility is based at least upon the combined amounts wagered on the machines over time.

17. The method of claim 16 further including establishing an initial super jackpot fund amount and incrementally increasing said fund over time to define a progressive super jackpot fund to be paid out when the super jackpot combination appears, the fund returning to the initial fund amount after said payout and incrementally increasing therefrom.

18. The method of claim 17 further including the supplier posting at each host facility the current amount of said super payout.

19. The method of claim 18 wherein said posting includes providing a display and means for remotely changing the display.

* * * * *